United States Patent [19]

Inoue

[11] 4,120,994

[45] Oct. 17, 1978

[54] METHOD OF PREPARING HEAT-TRANSFER MEMBERS

[75] Inventor: Kiyoshi Inoue, Tokyo, Japan

[73] Assignee: Inoue-Japax Research Incorporated, Yokohama, Japan

[21] Appl. No.: 556,203

[22] Filed: Mar. 7, 1975

[30] Foreign Application Priority Data

| | | | |
|---|---|---|---|
| Mar. 11, 1974 | [JP] | Japan | 49-27077 |
| Nov. 6, 1974 | [JP] | Japan | 49-127713 |
| Nov. 29, 1975 | [JP] | Japan | 50-138062 |
| Jan. 14, 1975 | [JP] | Japan | 50-6695 |

[51] Int. Cl.[2] ..... B05D 3/12

[52] U.S. Cl. ..... 427/239; 427/328; 165/133; 428/612; 204/29; 427/436; 427/292; 428/613

[58] Field of Search ..... 204/16, 23–27, 204/181; 165/133; 427/239, 292, 328, 436–438

[56] References Cited

U.S. PATENT DOCUMENTS

| | | | |
|---|---|---|---|
| 3,311,493 | 3/1967 | Schunemann | 427/239 |
| 3,884,772 | 5/1975 | Shiga | 204/16 |

OTHER PUBLICATIONS

Chemical Surface Treatment, Wiederholt, 12/23/65, p. 97.

Transactions of the Institute of Metal Finishing, 1954, 31, 517–526, The Electrodeposition of Porous Coatings, C. Faust, et al.

*Primary Examiner*—Ronald H. Smith
*Assistant Examiner*—Sam Silverberg
*Attorney, Agent, or Firm*—Karl F. Ross

[57] ABSTRACT

A method of preparing a heat-transfer member having a porous metallic heat-transfer interface comprising the steps of:

(a) disposing at least one surface of a substrate in contact with a solution containing a salt of a thermally conductive metal, and (b) depositing said metal from said solution upon said substrate so as to form a dendritic metallic layer thereon constituting said porous heat-transfer interface.

6 Claims, 7 Drawing Figures

METHOD OF PREPARING HEAT-TRANSFER MEMBERS

FIELD OF THE INVENTION

The present invention relates to a method of preparation heat-transfer members, e.g. evaporators and condensers and, more particularly, to an improved method of making a porous metallic heat-exchange interface.

BACKGROUND OF THE INVENTION

Heat-exchanger devices of tubular, planar and other configurations with a porous metallic surface layer have been proposed in the art. Such a layer is known to provide a highly efficient thermal interface by virtue of the extended effective surface areas for transferring the heat compared with smooth and conventional finned thermal interfaces. Furthermore, with the porous interface in contact with a boiling liquid, the individual pores or cavities when properly sized and distributed serve to provide highly effective sites for bubble nucleation and thus promote the nucleate bubbling (bubble forming and growing) process. As a result, effective heat transfer coefficients 10 times greater than conventional fin-type members or even more can be obtained.

Heretofore, various techniques have been applied in order to produce heat-transfer interfaces of a desired porosity with necessary mechanical properties but have been found to be more or less defective or unsatisfactory especially where they are to be exploited for production on commercial scale. Especially it has been extremely difficult to produce a large quantity of desired porous heat-transfer members of uniform quality economically. With spray coating technique in which fused metallic particles are sprayed upon a substrate, it is difficult to obtain a structure which possesses both sufficient and uniform porosity and adhesiveness. Sintering, brazing or soldering metallic particles onto a substrate involves relatively complicated steps which are hard to automate and consequently have rendered the products costly. Furthermore, they may be impractical when curved or elongated tubings or other surfaces of intricate geometries are to receive particles intimately bonded thereto. Where a desired porous structure is to be formed integral with the inside wall of a tubular member, honeycomb or other irregularly shaped surfaces, any of these techniques cannot be effectively utilized.

SUMMARY OF THE INVENTION

It is therefore the object of the present invention to provide an improved method whereby a large quantity of desired porous heat-transfer members of uniform quality can be obtained economically and which enables a desired porous heat-transfer structure of excellent characteristics to be readily produced integral with practically any heat-transfer substrate.

The method of preparing a heat-transfer member having a porous metallic heat-transfer interface according to the present invention basically comprises the steps of disposing at least one surface of a substrate in contact with a solution containing a salt of a thermally conductive metal and depositing said metal from said solution upon said substrate chemically or electrochemically so as to form a dendritic metallic layer thereon constituting said porous heat-transfer interface.

It is desirable that the surface of the substrate be first mechanically roughened or flawed so that a multitude of minute protrusions are formed thereon in closely spaced relationship and in a uniform distributor to provide sites on which deposition should take place preferentially. It has been found that this preparatory treatment is highly effective to form dendrites uniformly over the entire surface and thus to enhance the eveness of the porous structure throughout the desired surface. To this end, flaws should advantageously be produced by scratching throughout the surface with a depth of cut around or greater than 0.1 mm and a spacing between adjacent cuts of 0.1 to 0.3 mm.

For the sake of insuring the effective formation of the desired dendritic structure and the uniformity thereof, it has also be found to be desirable that the solution in contact with the substrate during the depositing operation be held at an elevated temperature ranging between 60° and 110° C, preferably higher than 90° C, near its boiling point.

It will be understood that the heat-transfer members may be used in conventional heat-transfer structures and that the term "heat-transfer members" is intended to be used in its broadest sense to include any member involved in heat transfer from one fluid to another. For example, heat-transfer tubes according to the present invention may be collected in tube nests or bundles and provided with the usual headers and housings to pass liquid through the tubes while a gas or vapor is passed along the outer surfaces thereof. The heat-transfer member may be a boiler or can form part thereof, in which case one wall of the member may be exposed to combustion products or a heat source while the other is in contact with the fluid to be heated.

Moreover, the heat-transfer member may be a "heat-pipe" device or can form part thereof. The heat pipe is basically a closed tube having a layer of capillary wick material attached to the interior surface of the tube wall. The tube is saturated with a volatile liquid, the particular liquid being chosen to conform to the particular temperature range desired. Heat is received by evaporation of liquid in high-temperature regions of the tube and transferred by vapor transport to colder regions, where the vapor recondenses on the surface thereof, thereby releasing the heat. The condensed liquid is then recycled by capillary action in the wick back to the heat input zone where it is again evaporated. The thermal energy is thus transported in a closed-loop and delivered to any desired cool region of the tube. Examples of heat-pipe devices are described in U.S. Pat. Nos. 3,152,774 and 3,229,759 issued to T. Wyatt and G. M. Grover, respectively.

When the internal surface of a tube is treated by the method according to the present invention, it has been found that the porous layer thereby provided throughout the inside wall serves as a highly efficient heat-exchanger interface former at its heat input and output regions and in addition as an excellent "wicking" or capillary layer across its intermediate region.

SPECIFIC DESCRIPTION

Figure 1:
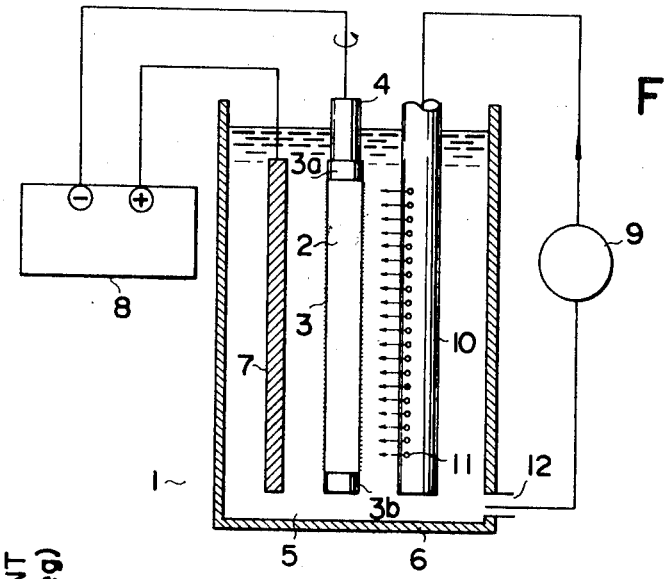
FIG. 1 is a diagrammatic view partly in cross section of an electrochemical deposition system used for carrying out the method of the present invention.

FIG. 1 shows an arrangement 1 used to embody the method of the present invention by electrochemically depositing a layer of dendrites upon the external surface of a tubular element 2, this layer as formed being indicated at 3. The tubular element 2 is securely mounted upon a mandrel 4 forming a cathode, and is immersed in a bath of electrolyte 5 received in a vessel 6 and is therein juxtaposed with an anodic electrode 7. The latter is connected with the positive terminal of a direct-current source 8 whose negative terminal is connected with the cathode 4 in the usual manner. The mandrel 4 is here rotatably supported and driven by a motor (not shown) for rotation during the electrochemical depositing operation. The liquid electrolyte 5 is introduced into the vessel 6 by a circulation pump 9 via a supply pipe 10 and is directed toward the revolving surface of the tubular element 2 upon the rotating mandrel 4 via a plurality of openings or nozzles 11 provided through the supply pipe 10. The liquid in the vessel 6 is drained through an outlet 12 and recirculated into the vessel 6 by the pump 9. It has been found to be important to impart a dynamic flow of the liquid electrolyte with respect to the surface of the substrate 2, preferably with a rate of flow being 1 meter/second or higher. By doing so, it has been found that the desired formation of a dendritic structure can be obtained with stability in a wide range of operating parameters. The tubular member 2 on the mandrel 4 in FIG. 1 is provided with seals at its upper and lower ends to avoid deposition there. It is also desirable to heat the electrolyte to an elevated temperature in a range between 60° and 110° C and to this end a heater may be provided in the path of the liquid circulation system or in the vessel 6. The current density should be as high as possible, say, up to 1000 amperes/dm$^2$, preferably between 400 and 800 amperes, and it has been found to be desirable to intermittently reduce the current density to a lower level to, say, as low as 10 amperes/dm$^2$. The control of the current density is effected by suitable control means (not shown) incorporated in the power source 8. By so doing, it has been found that the degree of dendritic concentration on the surface can be readily controlled. The dendritic structure formed on the surface is desirably subjected to annealing treatment and by so doing, it has been found that the resulting structure has an increased durability and lends itself readily to bending.

EXAMPLE I

With an arrangement basically as shown in FIG. 1, a dendritic layer of nickel was formed on the exterior surfaces of copper tubings each having an outer diameter of 10 mm and a thickness of 0.1 mm. The liquid electrolyte used had a composition of : 200 grams/liter of $NiCl_2 \cdot 6H_2O$; 50 grams/liter of $NiSO_4 \cdot 6H_2O$; 45 grams/liter of $H_3BO_3$ and 3 milliliter/liter of a surfactant, was injected through nozzles 11 toward the tubing 2 at a rate of 1 meter/sec. and has a temperature elevated at 80° C. The anode was platinum and the cathode mandrel carrying the copper tubing was rotated at 7 rotations per second. The current density was 500 amperes/dm$^2$ which was reduced to 50 amperes/dm$^2$ at intervals of 30 seconds. As a result of the operation for three minutes, the tubing had a dendritic layer of a thickness of 0.4 to 0.5 mm. Some of the tubings were in advance mechanically roughened or flawed to have a multitude of cuts of a depth of 0.1 mm closely spaced from one another throughout the entire surface whereas the remainder had smooth surface before being subjected to the deposition process.

Figure 2:
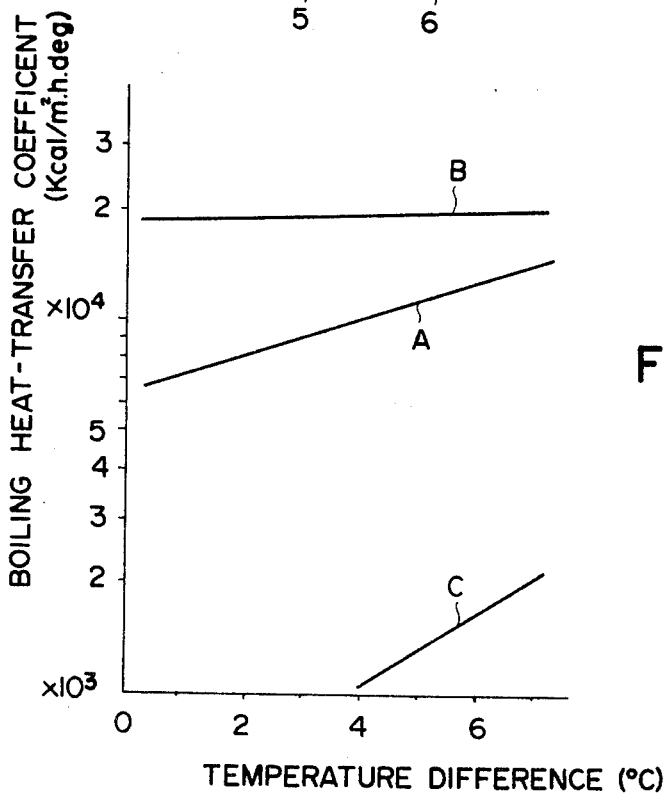
FIG. 2 is a graph comparing thermal efficiencies of porous heat-transfer members prepared by the present method with that of conventional fin-type heat-transfer members.

Thermal efficiencies of the resulting tubings were tested by disposing each tubing horizontally in a static fluid medium at a temperature between 20° and 100° C and passing through the tubing a hot fluid at a temperature between 120° and 150° C and the graph of FIG. 2 was obtained in which the boiling heat-transfer coefficient is plotted along the ordinate with respect to the temperature difference between the interior and exterior of the tubing plotted along the abscissa. In the graph, the curve A represents the data of the tubings resulting from electrochemical deposition on smooth tubing surfaces whereas the curve B represents data obtained by electrochemical deposition on tubing surfaces roughened in the manner as stated above. It is seen that the mechanical pre-roughening leads to a significant improvement in the boiling heat-transfer coefficient of electrochemically formed porous surfaces. In the graph, the corresponding data of conventional fin-type heat-transfer surfaces is also included as curve C for comparison purposes.

Figure 3:
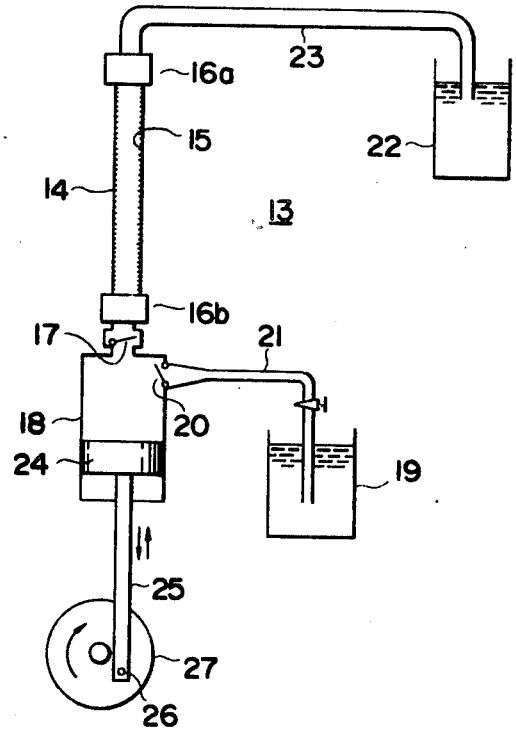
FIG. 3 is a sectional view illustrating a chemical deposition system used for carrying out the method of the present invention.

FIG. 3 shows an apparatus 13 for chemically depositing the internal surface of a tubing 14 to form uniformly thereon a layer of dendrites 15 from a solution, embodying the present invention. In this system, the tubing 14 is held in position by a pair of sleeve-like holder members 16*a* and 16*b*. The holder member *b* couples the interior of the tubing via a valve with a cylinder chamber 18 which is in turn coupled with a liquid supply tank 19 via a valve 20 and a supply conduit 21 whereas the holder member 16*a* couples the tubing interior with a liquid collection tank 22 via a conduit 23. Slidably received in the cylinder chamber 18 is a piston 24 having a piston rod 25 protruded from the housing 18 and coupled with a crank shaft 26 of a rotary crank arrangement 27 as shown. As the rotary disk of this arrangement is rotated by a motor (not shown) in the direction of the arrow, the piston 24 is displaced up and down in the cylinder chamber 18.

During the stroke in which the piston 24 is in downward displacement, the valve 17 is closed and the valve 20 is opened because the pressure in the space above the piston in the cylinder chamber becomes nagative and the liquid solution is drawn into said space from the tank 19 via the conduit 21 for temporary storate therein. As soon as the piston 24 commences moving upward, the valve 20 is closed and the valve 17 opened permitting the liquid solution in the cylinder space 18 to be forced into the tubing 14 to drive the waste liquid therein into the collection tank 22 via the conduit 23 while replacing it with a given amount of the fresh liquid stored in the chamber 18.

As the fresh liquid is introduced into the tubing 14, a reduction reaction takes place on the interior surface of the tubing and metal is deposited thereon. It is desirable in advance to wash this surface with sodium hydroxide or the like solution and sensitize it by bringing it in contact with a solution of stannous chloride to form deposits of stannous ions thereon and after re-washing, to activate the surface by bringing it in contact with a solution of palladium chloride to form deposits of palladium thereon as an activating or catalytic substance (reduction nuclei) to receive the depositing metal. After the piston 24 is switched to move downwardly, the deposition process will continue within the interior space of the tubing 14 and the solution in the latter is again refleshed when the next switching in the displacement direction of the piston 24 is produced. In this manner, by intermittently replacing the depositing solution within the tubing 18, the dendritic layer develops on the interior surface and uniformly grows its thickness while retaining its high porosity with interconnected capillary pores of a desired size. Resulting products are highly effective when used as heat pipes.

EXAMPLE II

A dendritic copper layer of 6.7 grams was deposited throughout the interior wall of a copper tubing of an outer diameter of 10 mm, an inner diameter of 8 mm and a length of 360 mm using an apparatus essentially shown in FIG. 3. The solution used comprised a mixture of 110 grams/liter of $CuSO_4 \cdot 5H_2O$, 346 grams/liter of $KNaC_4H_4O_6 \cdot 4H_2O$ and 100 grams/liter of NaOH and additionally contained as a reduction promoting agent 10 parts of 37% by weight aqueous solution of formalin to 15 parts of the mixture. Its temperature was 35° C. In one cycle of the operation as described above, copper of 0.16 grams was deposited and the cycle was repeated 42 times.

The resulting structure was found to be highly effective not only as usual heat exchanger interfaces but also as the capillary "wicking" body in heat pipes.

The heat pipe so prepared was hermetically sealed with its interior evacuated at a vacuum of $10^{-3}$ Torr and partially filled with 2000 $mm^3$ of water as working liquid.

Figure 4:
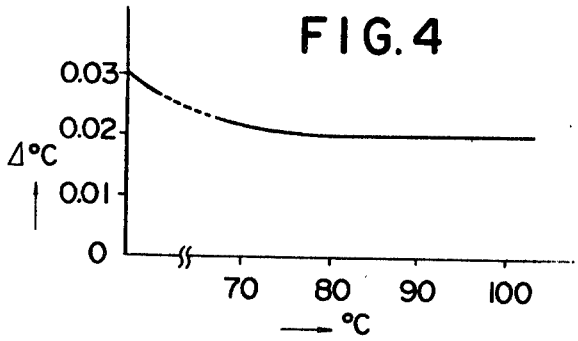
FIG. 4 is a graph showing the thermal efficiency of a heat pipe prepared according to the present invention.

The performance of the resulting heat pipe is shown in the graph of FIG. 4 in which the temperature difference between the evaporator zone and the condenser zone is plotted in the ordinate with respect to the temperature at the condenser zone plotted in the abscissa. It is seen that the very nearly isothermal profile with a temperature difference as low as 0.02° C is obtained. This heat pipe is operable with an angle of its altitude covering 0° to 80° C.

Figure 5:
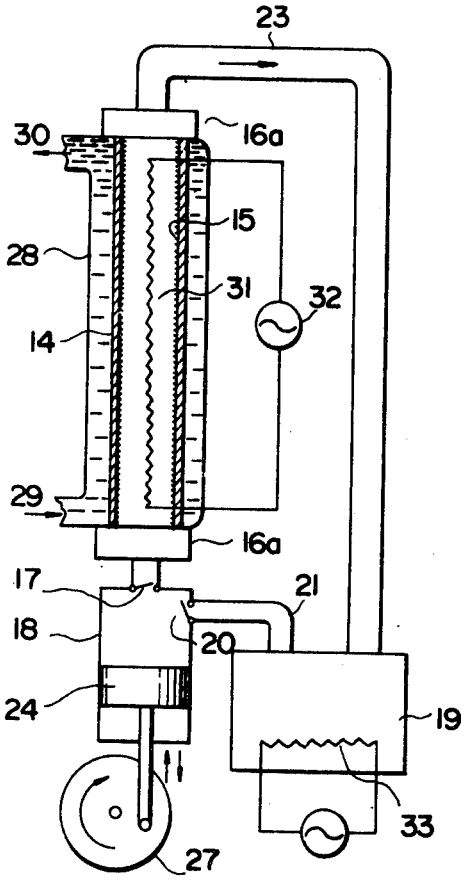
FIG. 5 is a modification of the system of FIG. 3 including heater means for holding the depositing solution at an elevated temperature.

In the system of FIG. 5 which has basically the same structure as that of FIG. 3, heater means are additionally provided. Thus, the tubing 14 to receive a dendritic layer 15 on its interior surface is housed in a heating chamber 28 having an inlet 29 and an outlet 30 for a circulating hot fluid. A heating coil 31 is also provided extending axially through the tubing 14 as shown and energized by a power source 32. The liquid solution in the tubing 14, for example, of the type mentioned previously is forced out into the outlet conduit 23 each time the piston 24 in upward travel and in this embodiment is returned to the supply tank 19. This latter also has a heating arrangement 33 provided therein which together with heaters 28 and 31 holds the liquid solution in the system at a temperature of 90° to 110° C, near its boiling point. A significant increase in the buildup and rate of growth of the dendritic layer proved to be obtained thereby.

Figure 6:
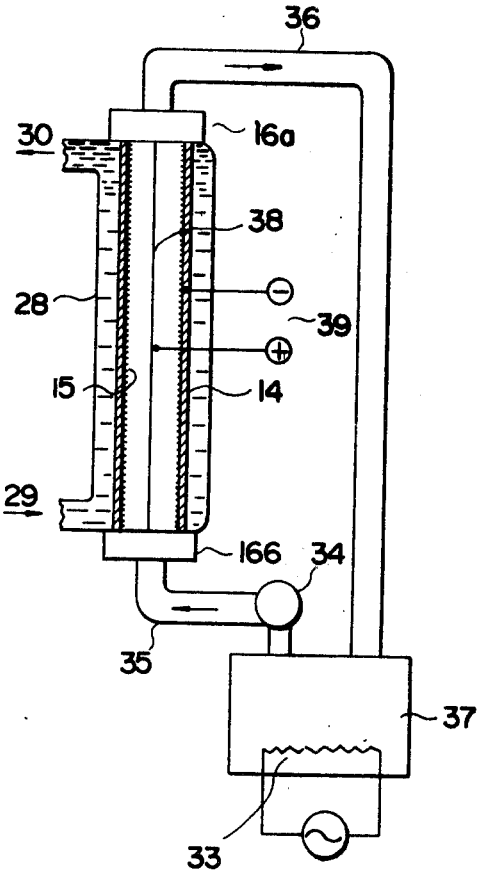
FIG. 6 is a sectional view of an electrochemical depositing system adapted to prepare a heat pipe according to the present invention and including heater means.

FIG. 6 illustrates a further embodiment of the present invention in which the heater means in the embodiment of FIG. 5 (28 to 30 and 33) is here again included and electrochemical deposition is utilized to form a dendritic porous structure 15 throughout the interior surface of a tubing 14 as in the preceding embodiment. Electrochemical depositing electrolyte is circulated through the tubing 14 by a pump 34, the circulating system including an inlet conduit 35 connected with the apertured holder member **16*b*. The upper holder member 16*a* leads electrolyte from the tubing to a return conduit 36 ending at a reservoir 37. The heating chamber 28 receiving the tubing and the electric heater 33 in the reservoir 37 holds the circulated electrolyte at an elevated temperature in a range between 90° and 110° C. Disposed axially through the tubing 14 is an elongated electrode 38 connected with the positive terminal of a direct-current source 49 whose negative terminal is connected electrically with the tubing 14** forming the counterelectrode for applying an electrochemical depositing current with a high current density in a range between 5 and 30 amperes/$cm^2$ between the electrodes.

EXAMPLE III

A dendric nickel layer was applied throughout the internal surface of a copper tubing of a length of 300 mm and a diameter (inner) of 15 mm, using an apparatus diagrammatically shown in FIG. 6. The electrolyte was composed of 600 grams/liter of nickel sulfamate $(NH_2SO_3)_2Ni$, 5 grams/liter of nickel chloride $NiCl_2$ and 40 grams/liter of boric acid $H_3BO_3$, heated at a temperature of 95° to 105° C and circulated through the tubing at a flow rate of 1.5 ml/min. The current density was held in a range of 30 to 5 amperes/$cm^2$ with the voltage of 5 to 15 volts. The tubing formed with the dendritic porous layer integral with the inner wall thereof to serve as a heat pipe was hermetically sealed with its inner space evacuated at a vacuum of $10^{-5}$ Torr and partially filled with 8 milliliter of water as working fluid. The tubing was disposed vertically. When the upper end zone was heated with the lower end forming the condenser zone, the thermal transport was 130 watts. Conversely, when the lower end zone was heated with the upper cooling zone, 220 watts of heat was successfully conveyed. When the pipe was disposed horizontally, the heat transfer was 152 watts.

According to another aspect of the present invention, the growth pattern of dendrites over the entire surface is regulated regionally in accordance with the particular function each of the different surface regions should assume and this has been found to be especially advantageous when a heat pipe is to be prepared. Thus, according to this aspect of the invention, the surface prior to the deposition treatment is machined in the manner that the two end portions of the pipe or tubing both have on their surfaces a greater proportion of a multitude of small cuts extending essentially transverse to the axial direction of the pipe and the intermediate portion, i.e., "wicking" portion, between the end portions has throughout its surface a greater proportion of a multitude of cuts extending essentially in parallel with the axis of the pipe. Subsequent deposition on the surface so pretreated has shown that the desired regional regulation of crystal growth directions is obtained and the resulting heat pipe has revealed a significant improvement both in heat-transfer (vaporization and condensation) and liquid-transport efficiencies.

Figure 7:
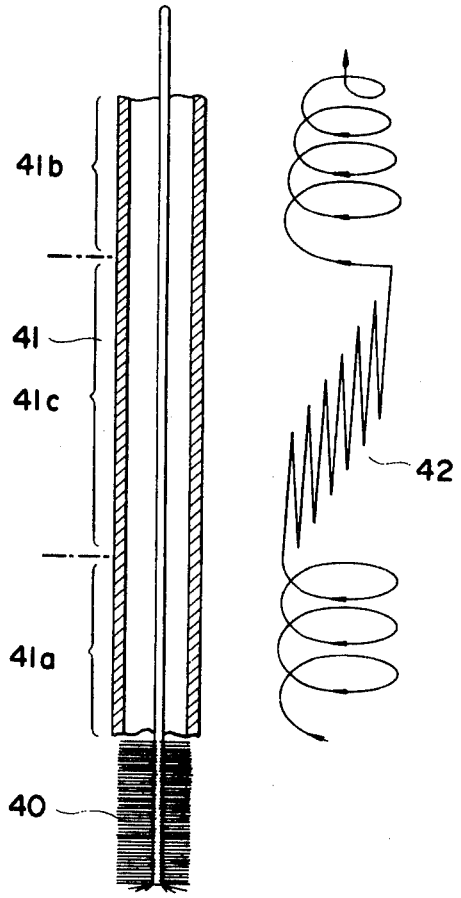
FIG. 7 is a diagrammatic view partly in cross section illustrating the manner of a certain preparatory treatment of the internal surface of a tube which is useful especially where a heat pipe is to be prepared therefrom.

In FIG. 7 which illustrates this pre-treatment, a brush 40 is shown to flaw the internal surface of a tubing 41 in different manners according to their particular surface regions, viz. regions 41*a* and 41*b* forming the vaporization and condensing zones respectively or vice versa and region 41*c* to form the "wicking" or liquid-transport passage. Shown at 42 in the right-hand side of FIGURE is a diagrammatic representation of the locus of the brushing of the tool 40. Thus, the brushing tool 40 inserted in the tubing 41 is first rotated in the region 41*a*, reciprocated in region 41*c* and again rotated in the region 41*b* to form numerous small correspondingly oriented grooves and protrusions on these surfaces.

EXAMPLE IV

A copper tubing of a length of 300 mm and an inner diameter of 15 mm was pre-treated in the manner just described and then subjected to the electrochemical depositing treatment using the same electrolyte and the parameters as used in the EXAMPLE III and a similar heat pipe was thereby prepared. About 50% of improvement in the heat transport capacity was observed in comparison.

I claim:

1. A method of preparing a tubular heat transfer member having a porous metallic heat-transfer interface, said member being tubing adapted to form an internal surface of a heat pipe having an evaporation zone, a condensation zone and an intermediate liquid transport zone, said method comprising the steps of (a) mechanically roughening the surface of said member by providing said surface with a multitude of small cuts to a depth of at least 0.1mm so as to form in the evaporation and condensation zones a greater proportion of a multitude of small cuts extending essentially transverse to the axial direction of said tubing and in said intermediate liquid transport zone a greater proportion of a multitude of small cuts extending essentially in parallel with the axis of said tubing; closely spaced from each other and uniformly distributed;

(b) disposing said surface of a substrate in contact with a solution containing a salt of a thermally conductive metal; and (c) depositing said metal from said solution upon said substrate so as to form a dendritic metallic layer thereon constituting said porous heat-transfer interface.

2. A method defined in claim 1, wherein the step (b) is carried out chemically.

3. A method defined in claim 1, wherein said solution is displaced relatively to said substrate during the step (b).

4. A method defined in claim 3, wherein said solution is held at a temperature between 60° and 110° C.

5. A method defined in claim 4, wherein said solution is held at a temperature not lower than 90° C.

6. A method as defined in claim 1, further comprising the step of annealing the substrate subsequent to the step (b).

* * * * *